United States Patent [19]

Gill

[11] Patent Number: 4,480,600

[45] Date of Patent: Nov. 6, 1984

[54] COMPACT ODD CYLINDER V-TYPE ENGINE

[75] Inventor: Lloyd T. Gill, Okemos, Mich.

[73] Assignee: General Motors Corporation, Detroit, Mich.

[21] Appl. No.: 381,075

[22] Filed: May 24, 1982

[51] Int. Cl.[3] ..... F02B 75/22

[52] U.S. Cl. ..... 123/52 MV; 91/183; 123/55 VS; 123/195 R; 123/508

[58] Field of Search ..... 123/52 MV, 55 R, 55 V, 123/55 VF, 55 VS, 55 VE, 192, 507, 508, 509, 195, 198 F; 92/149; 91/183

[56] References Cited

U.S. PATENT DOCUMENTS

| | | | |
|---|---|---|---|
| 2,143,935 | 1/1939 | Chandler | 123/195 A |
| 2,231,264 | 2/1941 | Friedrich et al. | 123/509 |
| 2,890,690 | 6/1959 | Dolza | 123/55 VE |
| 3,728,995 | 4/1973 | Schramm | 123/198 R |
| 4,054,108 | 10/1977 | Gill | 123/52 MV |
| 4,391,258 | 7/1983 | Claesson | 123/508 |
| 4,433,657 | 2/1984 | Levinson | 123/DIG. 7 |
| 4,440,120 | 4/1984 | Butler | 123/52 M |

FOREIGN PATENT DOCUMENTS

| | | | |
|---|---|---|---|
| 722126 | 7/1942 | Fed. Rep. of Germany | 123/55 R |
| 966708 | 7/1949 | Fed. Rep. of Germany | 123/508 |

*Primary Examiner*—Craig R. Feinberg
*Attorney, Agent, or Firm*—Robert J. Outland

[57] ABSTRACT

A compact V-type engine arrangement wherein an odd number of cylinders are formed in opposite cylinder banks of differing lengths with the shorter bank having one less cylinder than the longer bank. A space adjacent the end of the shorter cylinder bank and generally opposite one of the cylinders of the longer bank is utilized to mount an engine driven mechanism, such as a diesel fuel injection pump, which is preferably connected to the individual cylinders for coaction therewith in timed relationship with the engine cycle. Novel compact means for driving the engine fuel injection pump or other mechanism, as well as other mechanical features, are also provided.

6 Claims, 7 Drawing Figures

COMPACT ODD CYLINDER V-TYPE ENGINE

TECHNICAL FIELD

This invention relates to V-type internal combustion engines and more particularly to a novel compact arrangement for V-type engines having an odd number of cylinders to provide space for an engine driven mechanism at one end of a shorter cylinder bank.

BACKGROUND

In the prior art relating to internal combustion engines it has been common to construct V-type engines having two V-arranged banks, each defining an equal number of longitudinally aligned cylinders disposed generally opposite one another. Usually, the cylinders of one bank are offset slightly to the rear of those of the other to provide for connection of the pistons of the opposite cylinder banks with adjacent crankpin areas of the engine crankshaft.

With such V-type engines it is known to provide various engine auxiliary and accessory devices which may be mounted in suitable convenient locations on the sides, front and rear of the engine as well as between the cylinder banks where possible, all as may be permitted by the space available for mounting the engine and its associated components. In the case of automotive engine compartments for some of the current models of compact and subcompact vehicles, the engine compartment space is relatively small, restricting the size and configuration of engine arrangements which may be suitably mounted within the engine compartments of such vehicles.

SUMMARY OF THE INVENTION

The present invention provides a novel engine arrangement providing a package of unusual compactness for mounting in the relatively crowded engine compartments of today's vehicles. A feature of the invention is that it provides a V-type cylinder bank arrangement defining an odd number of cylinders arranged in longer and shorter cylinder banks with one less cylinder in the shorter bank. Another feature is that a space is provided at one end of the shorter cylinder bank and generally opposite one of the cylinders of the longer bank for mounting an engine driven mechanism without greatly increasing the required length of the overall engine arrangement. Still another feature is that the engine driven mechanism is driven directly by the engine camshaft through novel and compact drive means.

In a specific embodiment the engine comprises a five cylinder V-type diesel engine having long and short cylinder banks containing three and two cylinders respectively. A space behind the short cylinder bank and generally opposite the rear cylinder of the long bank is utilized for receiving the diesel fuel injection pump which is connected by fuel lines with injection nozzles communicating with the combustion chambers of each of the cylinders to deliver fuel thereto. Compact drive means are provided to drive the injection pump from the engine camshaft to provide fuel charges to the cylinders on a timed cyclic basis related to the operational cycle of the engine. The combined structure forms the basis of a compact engine package adaptable for installation in relatively small engine compartments of automotive vehicles.

These and other features and advantages of the invention will be more fully understood and appreciated from the following description of a specific embodiment taken together with the accompanying drawings.

BRIEF DRAWING DESCRIPTION

DETAILED DESCRIPTION

Figure 1:
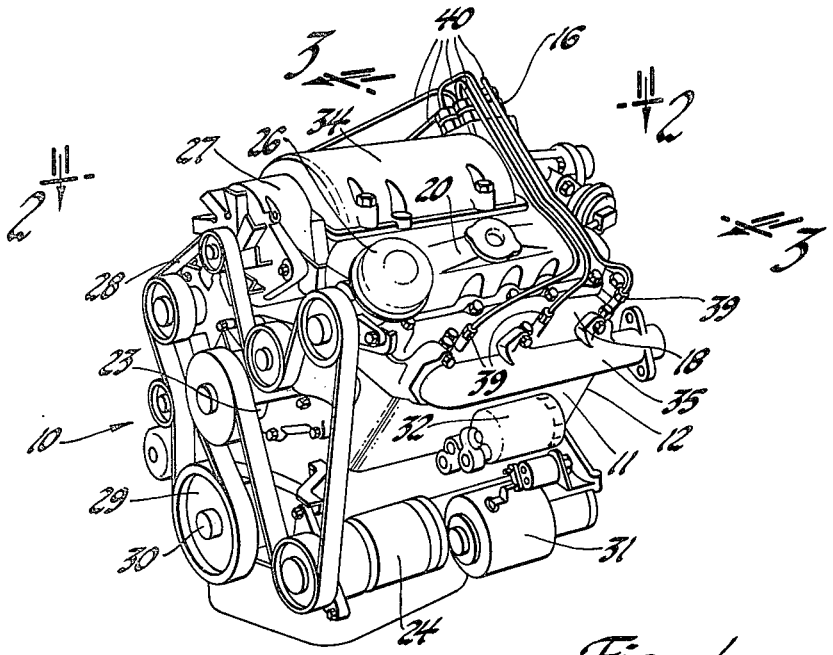
FIG. 1 is a pictorial view of a five cylinder V-type diesel engine assembly of compact configuration in accordance with the invention.
Figure 2:
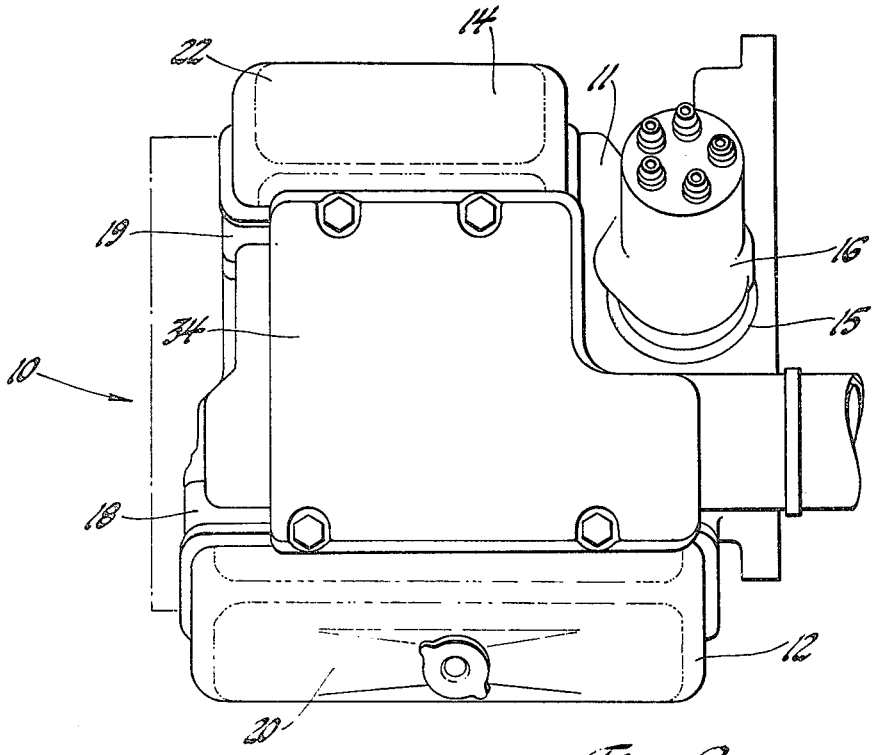
FIG. 2 is a plan view from the plane indicated by the line 2—2 of FIG. 1 with certain of the engine components deleted for clarity.
Figure 3:
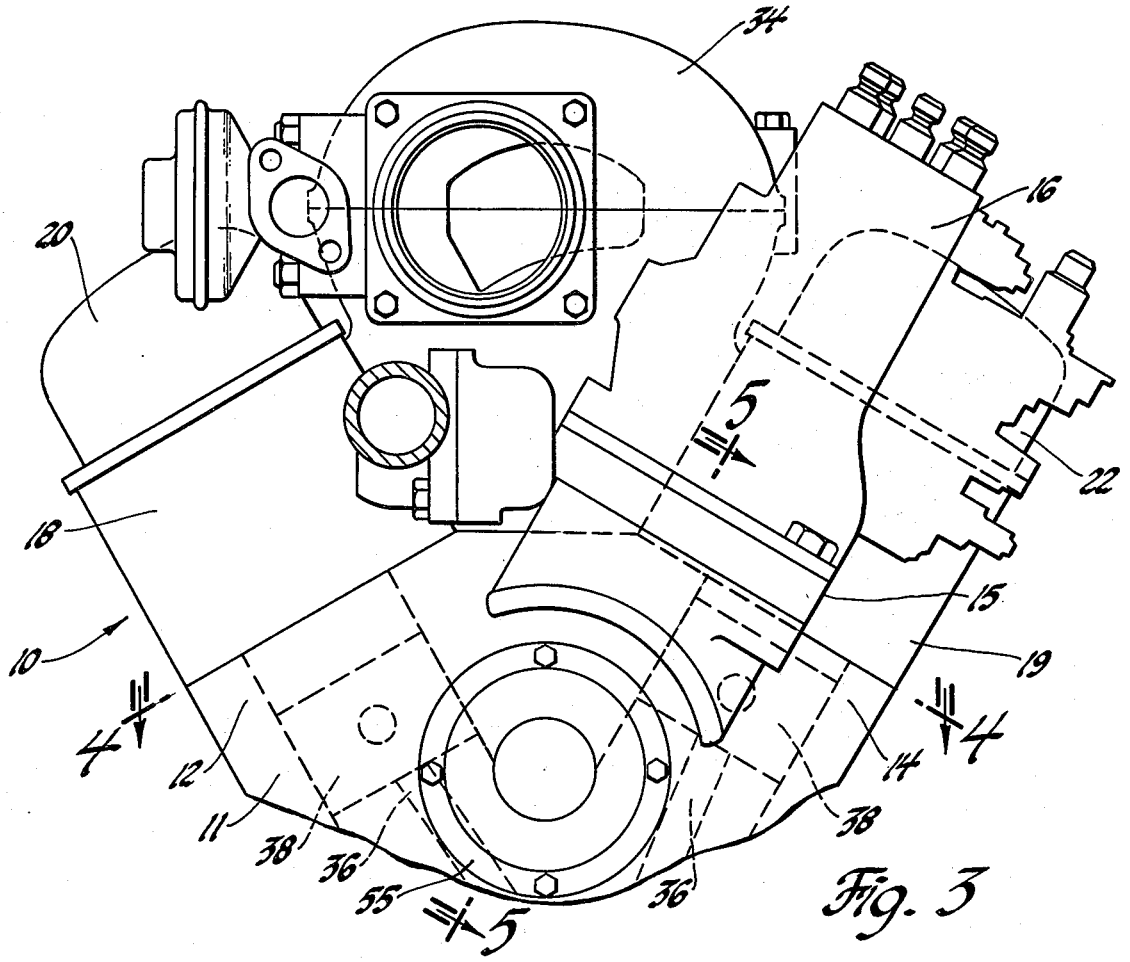
FIG. 3 is a partial rear end view from the plane indicated by the line 3—3 of FIG. 1, with certain of the components deleted.
Figure 4:
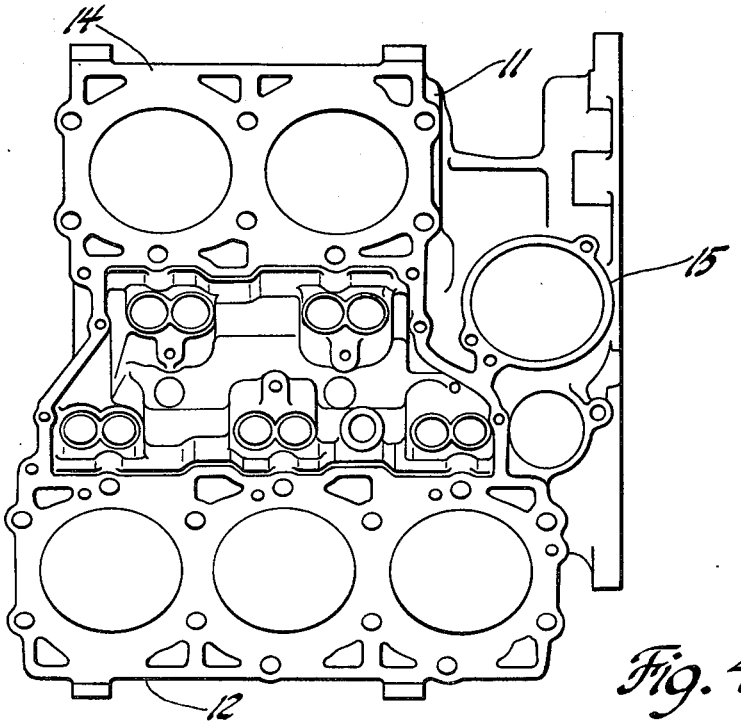
FIG. 4 is a top plan view of the engine cylinder block from the plane indicated by the line 4—4 of FIG. 3.

Referring now to the drawings in detail, there is shown in illustration of a specific embodiment of the invention an internal combustion engine generally indicated by numeral 10. Engine 10 is a five cylinder 60° V-type diesel engine having a cylinder block 11. The cylinder block defines left and right cylinder banks 12, 14 respectively arranged with a relative bank angle of 60° and each including a plurality of longitudinally aligned cylinders.

In the present embodiment the left cylinder bank 12 defines three aligned cylinders. The right cylinder bank 14 defines only two aligned cylinders lying generally opposite, but slightly offset toward the rear of the engine from, the front two cylinders of the left bank. A mounting boss 15 supporting a diesel fuel injection pump 16 is provided on the cylinder block behind the right cylinder bank 14 and generally opposite, though offset rearwardly, from the rear cylinder of the left bank. The ends of the cylinders are closed by left and right bank cylinder heads 18, 19 respectively which are provided with rocker covers 20, 22 respectively. The cylinder heads and their respective rocker covers are considered, from the standpoint of the succeeding description and claims, to be included as part of the respective cylinder banks to which they are attached.

The engine is additionally provided with a number of externally mounted components or accessories including a water pump 23, air conditioning compressor 24, vacuum pump 26, alternating current generator 27, and other pulley connected devices driven through a single serpentine multi-groove drive belt 28 by a pulley 29 mounted on the end of the engine crankshaft 30. An electrical starter 31 and an oil filter and mounting body 32 are mounted alongside the cylinder block.

The engine package also includes a compact ram tube plenum type air intake manifold 34 mounted between the cylinder banks and supporting various associated components. The manifold arrangement is disclosed in detail in copending U.S. patent application Ser. No. 381,076 filed contemporaneously with this application and assigned to the assignee of the present invention. Exhaust manifolds, such as left bank manifold 35, are carried by the cylinder heads on the outboard sides of the cylinder banks.

The crankshaft 30 is rotatably supported in the lower portion of the cylinder block 11 in conventional fashion and includes a plurality of crank throws having crankpins, not shown, that are connected by connecting rods 36 with pistons 38, one in each of the engine cylinders. The pistons, together with the cylinders and cylinder heads, define combustion chambers that include portions not shown within the cylinder heads. Conventional means, not shown, are provided in the heads for receiving air charges from the intake manifold and conducting burned gases out to the exhaust manifolds.

In addition fuel injection nozzles 39 carried in the cylinder heads communicate with the individual combustion chambers, one for each cylinder, to deliver fuel charges thereto. High pressure fuel lines 40 connect between the fuel injection pump 16 and the individual injection nozzles 39 to provide for the timed delivery of the fuel charges in conventional manner.

Figure 5:
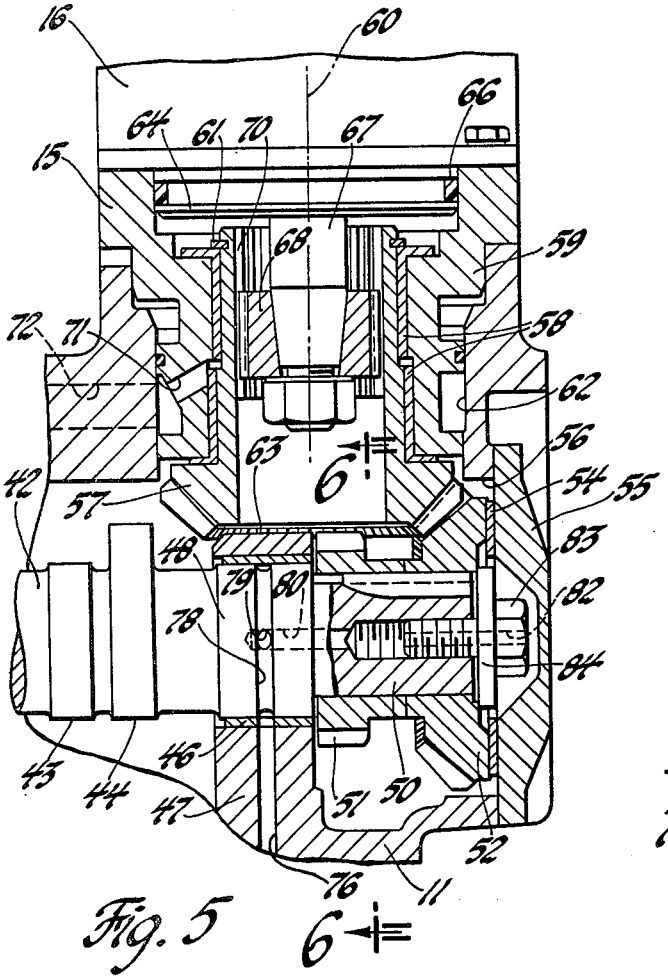
FIG. 5 is a fragmentary cross-sectional view of the injection pump drive arrangement taken in the plane indicated by the line 5—5 of FIG. 3.
Figure 6:
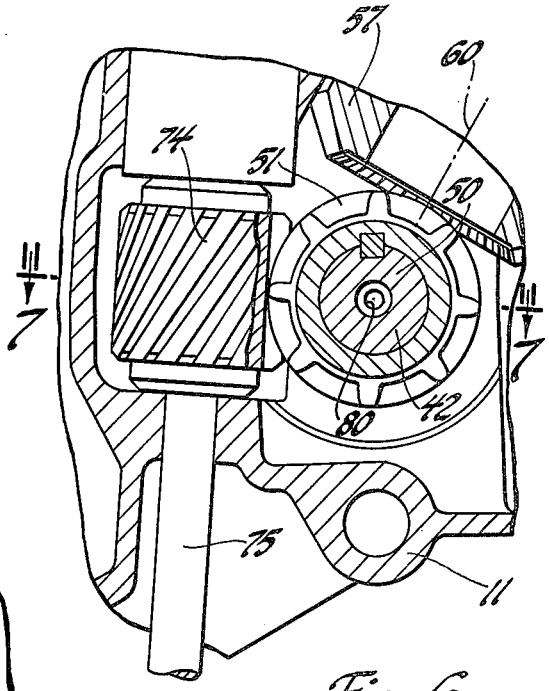
FIG. 6 is a fragmentary transverse cross-sectional view of the oil pump drive mechanism from the plane indicated by the line 6—6 of FIG. 5.
Figure 7:
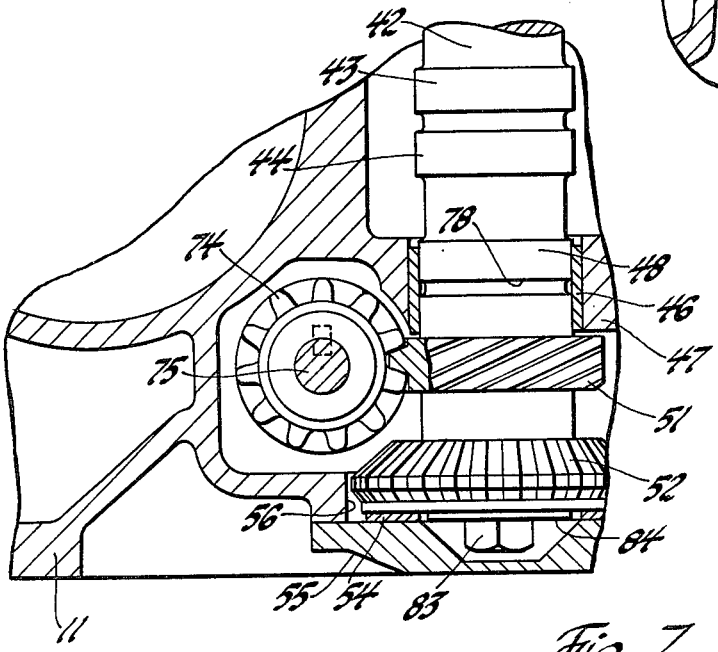
FIG. 7 is a cross-sectional view of the pump drive gears from the plane indicated by the line 7—7 of FIG. 6.

As is best shown in FIGS. 5–7, the engine cylinder block carries a camshaft 42 which is rotatably journaled on a longitudinal axis lying parallel with and above the crankshaft and driven therefrom through conventional means, such as a front mounted timing chain not shown. Camshaft 42 includes a plurality of spaced pairs of cams 43, 44 provided for operating the additional valve gear, not shown, for the individual engine cylinders.

Adjacent the rearmost cam 44, the camshaft is supported by a sleeve bearing 46 carried in a transverse wall 47 of the engine cylinder block and engaging a journal 48 of the camshaft. Aft of this journal, the camshaft is provided with a keyed end 50 on which are mounted a helical oil pump drive gear 51 and a spiral bevel injection pump drive gear 52. The rear face of the spiral bevel gear engages a thrust bearing 54 that is supported by a cap 55 secured on the engine cylinder block to cover an opening 56 in the rear end wall through which the gears 51, 52 may be installed.

The novel drive arrangement for the fuel injection pump further includes a driven spiral bevel gear 57 rotatably journaled on bearings 58 in an adapter 59 for rotation on an axis 60 extending normal to the axis of the camshaft 42 with the teeth of the driven gear 57 engaging those of the drive gear 52. A snap ring 61 engages one of the bearings 58 and a groove in the end of gear 57 distal from the gear teeth to retain the gear and adapter in assembly. The adapter 59 is seated on the mounting boss 15 and received in an opening 62 within boss 15, extending downwardly within the cylinder block to the camshaft. The internal block wall 47 is cut away at 63 to provide clearance for the face of the driven gear 57 which extends across the wall and closely adjacent the rear cam 44, thus providing a close coupled rear drive arrangement.

The fuel injection pump 16 is fixedly secured to the upper end of the adapter 59 and includes a pilot protrusion 64 that carries a seal 66 and from which there extends an end of a drive shaft 67 for the injection pump. Shaft 67 carries an externally splined member 68 that engages internal splines 70 formed within the driven gear 57 to provide for driving the injection pump directly upon rotation of gear 57. Oil for lubricating the gear and spline assembly is provided through a drilled passage 71 in the adapter 59 from a pressure oil gallery 72 in the engine cylinder block.

The compact gear drive arrangement also includes an oil pump drive including the gear 51 carried on the camshaft, which drives a helical gear 74 carried on a rotatable shaft 75 that extends through the cylinder block into the crankcase for connection with an oil pump not shown. The driven helical gear 74 engages the drive gear 51 at a point angularly spaced about the camshaft axis from the axis 60 of the injection pump drive gear to permit the compact arrangement of oil and injection pump drive means provided.

In the specific embodiment illustrated, it is apparent that a very compact V-type engine package has been provided utilizing an arrangement having cylinder banks of different lengths with an unequal number of cylinders, so as to provide space behind the shorter bank for mounting the fuel injection pump in a location substantially occupying space which would have been occupied by another engine cylinder in a conventional V-type engine having an even number of cylinders. Further to accommodate this arrangement, the intake manifold inlet end is suitably offset to one side of the fuel injection pump location. Also, a novel compact drive arrangement is provided for driving from the engine camshaft the fuel injection pump and the engine oil pump with a minimum of added length of the engine assembly behind the rearmost of the valve gear actuating cams.

Lubrication of the thrust bearing 54, provided behind the injection pump drive gear 52 to take the thrust developed by this gear and the oil pump drive gear together, is provided from a drilled oil passage 76 in the wall 47. The oil is directed through the sleeve bearing to a groove 78 in the camshaft journal 48, then through drilled passages 79 and 80 in the camshaft and a companion passage 82 in the bolt 83 that engages a washer 84 to retain the gear 52 on the end 50 of the camshaft. From the passage 82, the oil passes into a recess in the cap 55 and is directed therefrom to the thrust bearing 54.

While the invention has been described by reference to a specific embodiment comprising a 60° V-type diesel engine, it should be apparent that the invention could be applied in numerous other forms and types of engine arrangements. For example a spark ignition engine could be utilized in an arrangement where an ignition distributor or other mechanism driven by the engine was mounted in the space provided in the disclosed embodiment for the engine fuel injection pump. Other bank angles could likewise be provided. Also, various odd numbered V-type cylinder arrangements could be utilized. In view of these and other changes which may be made within the spirit and scope of the inventive concepts described, it is intended that the invention not be limited to the disclosed embodiment but that it have the full scope permitted by the language of the following claims.

The embodiments of the invention in which an exclusive property or privilege is claimed are defined as follows:

1. A compact internal combustion engine comprising a frame supporting a crankshaft for rotation on a longitudinal axis and defining an odd number of cylinders arranged in two substantially straight banks of longitudinally aligned cylinders radiating in V fashion from a common axis, one of said cylinder banks being shorter and having one less cylinder than the other, the cylinder banks being arranged to leave a cylinder free space at one end of the shorter bank and in generally opposite lateral relation to one of the cylinders of the other bank, pistons in the cylinders and connected with respectively aligned throws of the crankshaft for driving the pistons in timed reciprocating motion in the cylinders on a predetermined operating cycle, and an engine driven mechanism connected with each of the cylinders and operative to time a repetitive function in the cylinders in relation to the engine operating cycle, said mechanism being disposed in said cylinder free space lying at said one end of the shorter cylinder bank and in generally opposite lateral relation to said one cylinder of the other bank, whereby a compact arrangement of the engine cylinders and associated mechanism is provided.

2. A compact diesel internal combustion engine comprising a frame supporting a crankshaft for rotation on a longitudinal axis and defining an odd number of cylinders arranged in two substantially straight banks of longitudinally aligned cylinders radiating in V fashion from a common axis, said banks being of longer and shorter lengths wherein the shorter bank contains cylinders one less in number than the cylinders of the longer bank and each of the cylinders in the shorter bank lies in generally opposite lateral relation to one of the cylinders in the longer bank with a cylinder free space lying on the side and at one end of the shorter bank in generally opposite lateral relation to an additional cylinder of the longer bank, pistons in the cylinders and connected with respectively aligned throws of the crankshaft for driving the pistons in timed reciprocating motion in the cylinders on a predetermined operating cycle, and an engine driven fuel injection pump connected with injection nozzles at each of the cylinders and operative to provide repetitive delivery of fuel charges into the cylinders in timed relation with the operating cycle, said injection pump being disposed on the side of the engine frame having the shorter bank of cylinders and in said cylinder free space lying at the one end of said shorter bank and in generally opposite lateral relation to said additional cylinder of the longer bank, whereby a compact arrangement of the engine cylinders and the associated fuel injection pump is provided.

3. An engine according to claim 2 wherein the generally opposite cylinders of the two cylinder banks are longitudinally offset to permit connection of the opposing pistons to longitudinally offset crankpin areas of the crankshaft, said frame further supporting a camshaft extending parallel with the crankshaft between the cylinder banks and having thereon longitudinally spaced cams engaging suitable valve actuating mechanism for controlling the timed induction of air charges to and exhaust of burned gases from the engine cylinders, said camshaft being operatively connected with the crankshaft for driving the camshaft in timed relation to the engine operating cycle, said fuel injection pump being drivingly connected with a driving end of the camshaft through drive means adjacent to the cams that actuate the valve gear of said additional cylinder of the longer cylinder bank.

4. An engine according to claim 3 and further comprising means mounting said fuel injection pump on the engine frame, said pump having a drive shaft with its rotational axis lying in a plane normal to the camshaft and inwardly of said driving end of the camshaft and an adjacent end of the engine frame, bearing means supporting the camshaft inwardly of said adjacent end of the frame, a driving bevel gear mounted on said driving end of the camshaft outward of said bearing means, and a driven bevel gear drivingly connected with the pump drive shaft and engaging the driving bevel gear at said driving end of the camshaft to provide a driving connection between the camshaft and the injection pump, said driven bevel gear lying along one side of the camshaft inwardly of the driving bevel gear and extending inwardly beyond said adjacent camshaft bearing support means but maintaining clearance therefrom and from adjacent ones of said cams on the camshaft beyond said camshaft bearing support, whereby a close coupled pump mounting and camshaft carried drive are provided.

5. An engine as defined in claim 4 and further comprising a helical drive gear mounted on the camshaft between the bearing mounting means and the bevel drive gear mounted on said end of the camshaft, said helical drive gear being engaged with a helical driven gear disposed beside the camshaft at a location angularly offset from the axis of the fuel injection pump to provide a spaced relationship between the helical driven gear and the adjacent bevel driven gear of the fuel injection pump, said helical driven gear being operatively connected with an engine oil pump for drivingly operating said oil pump.

6. An engine in accordance with claim 4 and further comprising an adapter provided in said engine frame and supporting said fuel injection pump, said adapter journaling said driven bevel gear within bearings provided in the adapter and means maintaining said adapter, driven bevel gear and injection pump in assembly, said adapter including oil passage means communicating with adjacent oil feed passages of the engine frame for distributing lubricating oil to the supporting bearings of the driven bevel gear.

* * * * *